United States Patent [19]

Grybowski et al.

[11] Patent Number: 5,071,678

[45] Date of Patent: Dec. 10, 1991

[54] PROCESS FOR APPLYING GAS PHASE DIFFUSION ALUMINIDE COATINGS

[75] Inventors: Edward J. Grybowski, Chester; Walter E. Olson, Vernon, both of Conn.

[73] Assignee: United Technologies Corporation, Hartford, Conn.

[21] Appl. No.: 594,455

[22] Filed: Oct. 9, 1990

[51] Int. Cl.[5] ..... C23C 16/00

[52] U.S. Cl. ..... 427/253; 427/255.1; 427/319; 427/399

[58] Field of Search ..... 427/253, 255.1, 319, 427/399

[56] References Cited

U.S. PATENT DOCUMENTS

| | | | |
|---|---|---|---|
| 1,770,177 | 7/1930 | Martin | 427/253 |
| 3,515,095 | 6/1970 | Baranow et al. | 118/49 |
| 3,979,273 | 9/1976 | Panzera et al. | 204/192 |
| 4,132,816 | 1/1979 | Benden et al. | 427/237 |
| 4,148,275 | 4/1979 | Benden et al. | 118/49 |
| 4,148,936 | 4/1979 | Grisik et al. | 428/253 |
| 4,501,776 | 2/1985 | Shankar | 427/253 |
| 4,687,684 | 8/1987 | Restall et al. | 427/248.1 |

OTHER PUBLICATIONS

Formation and Degradation Mechanisms of Aluminide Coatings on Nickel-Base Superalloys by G. W. Goward, D. H. Boone and G. S. Giggins—Transaction of ASM.

Mechanisms of Formation of Diffusion Aluminide Coatings on Nickel-Base Superalloys by G. W. Goward and D. H. Boone—Oxidation of Metals; vol. 3, No. 5.

*Primary Examiner*—Bernard Pianalto

*Attorney, Agent, or Firm*—James M. Rashid

[57] ABSTRACT

A process for forming a diffusion coating to the surface of a metal article. The process is particularly adapted for forming diffusion aluminide coatings on metal blades and vanes used in gas turbine engines. According to the invention, halide vapor is caused to react with a source of aluminum to form an aluminum rich halide gas. This gas then reacts with the part surface to form the aluminide coating. A key aspect of the invention relates to the timing of the reaction between the halide vapor and the source of aluminum.

16 Claims, 2 Drawing Sheets

PROCESS FOR APPLYING GAS PHASE DIFFUSION ALUMINIDE COATINGS

TECHNICAL FIELD

The present invention relates to a process and apparatus for applying metal coatings to metal articles. It particularly relates to a process and apparatus for applying gas phase diffusion aluminide coatings to metal articles.

BACKGROUND ART

Diffusion aluminide coatings are known to provide oxidation and corrosion resistance to many types of metal alloys. Diffusion aluminide coatings are particularly useful for improving the properties of parts fabricated from nickel and cobalt based superalloys used in high temperature environments such as gas turbine engines. Rotating blades and stationary vanes are examples of gas turbine engine components which are coated with diffusion aluminide coatings.

Diffusion aluminide coatings (also referred to simply as aluminide coatings) may be applied by two different processes, pack processes and gas phase processes. In a typical pack process, the part to be coated is embedded in a powder mixture within an enclosure or retort. The mixture contains a source of aluminum, a halide activator, and (optionally) an inert filler material which, in conjunction with the activator, controls the nature of the coating formed. To carry out the coating process, the part to be coated and the powder mixture it is embedded within are heated to a temperature of about 760° C. in an inert atmosphere. At such temperature, the activator vaporizes and reacts with the aluminum source to form an aluminum rich halide vapor. (It should be pointed out that the coating industry describes the formation of gaseous activator as a vaporization process, as well as a sublimation or volatilization process. Such terms are used as synonyms herein.) The activator vapor reacts with the part to form a nickel aluminide or cobalt aluminide coating on the part surface, depending on whether the part is fabricated from a nickel or cobalt base superalloy. The thickness and composition of the aluminide coating depends upon the time and temperature of the process, as well as the activity of the powder mixture and composition of the part being coated.

Representative patents showing pack aluminide processes are those to Puyear et al., U.S. Pat. No. 3,079,276; Fitzer, U.S. Pat. No. 2,886,469; Supan, U.S. Pat. No. 3,335,028; Brill-Edwards, U.S. Pat. No. 3,693,255; Speirs et al., U.S. Pat. No. 3,764,373; and Boone et al., U.S. Pat. No. 3,544,348.

Some gas turbine engine blades and vanes are hollow, and have internal passages through which air is flowed during engine operation. The walls which define such passages require a coating to provide oxidation and corrosion resistance to the part. Pack processes are not efficiently utilized in coating internal blade and vane passages because of difficulties encountered in filling the passages with the pack powder mixture, and then removing such mixture after the coating process is completed. However, the gas phase diffusion aluminide process is particularly useful for coating internal passages. In the gas phase process, the part to be coated is suspended over a powder mixture within a retort which contains a source of aluminum, a halide activator, and (optionally) an inert filler material. The contents of the retort are heated to a temperature in the range of about 1,010° C.–1,120° C., which results in the formation of an aluminum rich halide vapor. The vapor is carried by a forced flow of inert gas into contact with the surfaces which define the internal passages and into contact with the external surfaces of the part, and the vapor reacts with the surfaces to form an aluminide coating. To allow the carrier gas and the aluminum halide vapor to escape from the retort, the retort includes vents or other such devices.

Representative patents showing gas phase aluminide processes are those to Gauje, U.S. Pat. No. 3,486,927 and Benden et al., U.S. Pat. No. 4,148,275, the contents of which are incorporated herein by reference.

Diffusion coatings having compositions other than the above-described simple aluminide compositions are also known to the gas turbine engine industry. For example, U.S. Pat. No. 4,835,011 to Olson et al. describes an aluminide coating containing oxygen active elements like yttrium. U.S. Pat. Nos. 4,933,239 and 4,919,092 to Olson et al., and 4,897,315 to Gupta describe aluminide coatings containing nickel, cobalt, chromium, yttrium, and, optionally, silicon, halfnium and noble metals. U.S. Pat. No. 4,501,776 to Shankar describes aluminide coatings containing platinum. U.S. Pat. No. 4,148,936 to Grisik et al. describes a diffusion coating based on chromium.

One deficiency of state-of-the-art gas phase diffusion coating processes is that the halide activator sublimes at a temperature less than the temperature at which the coating actually forms on the part surface. (The temperature at which the coating actually forms on the part surface is referred to below as the coating temperature.) As a result, by the time the powder mixture and the part reach the coating temperature, much of the activator has sublimed and has passed out of the retort, through the vents in the retort, and is therefore wasted. For these reasons, the diffusion coating industry seeks a process for applying gas phase diffusion coatings more efficiently.

SUMMARY OF THE INVENTION

According to this invention, an improved process for applying a gas phase diffusion coating to the surface of a metal part comprises the steps of heating the part to be coated, a halide activator, and a source of metal capable of reacting with the activator to form a metal rich halide gas, and then reacting the metal rich halide gas with the part at a coating temperature sufficient for the coating to form on the part surface, wherein the improvement comprises delaying the moment at which the activator first reacts with the metal source until such time that the part to be coated is at the coating temperature. Thereafter, and for the duration of the process, activator vapor is reacted with the metal source to produce a metal rich halide gas which forms the coating on the part surface. Carrying out the process in this fashion results in an optimum use of activator, and a controlled and efficient formation of a diffusion coating on the part surface.

In a preferred embodiment of the invention, a constant amount of halide activator is brought into contact with the metal source at equally spaced intervals of time during the coating cycle after the part has reached its coating temperature.

The foregoing and other features and advantages of the present invention will become more apparent from the following description and accompanying drawings.

BEST MODE FOR CARRYING OUT THE INVENTION

The process and apparatus described below is particularly useful for the gas phase deposition of simple aluminide coatings, such as the type described by the above-referenced patent to Benden, onto the surface of metal parts. However, it is equally useful in the formation of aluminide coatings of a more complex nature, such as those described by the above referenced patents to Olson and others. Finally, it is also useful in the formation of diffusion coatings based on elements other than aluminum, such as diffusion coatings based on chromium. The invention is best understood by reference to FIG. 1, and will be described with reference to the application of a simple aluminide coating to metal parts.

Figure 1:
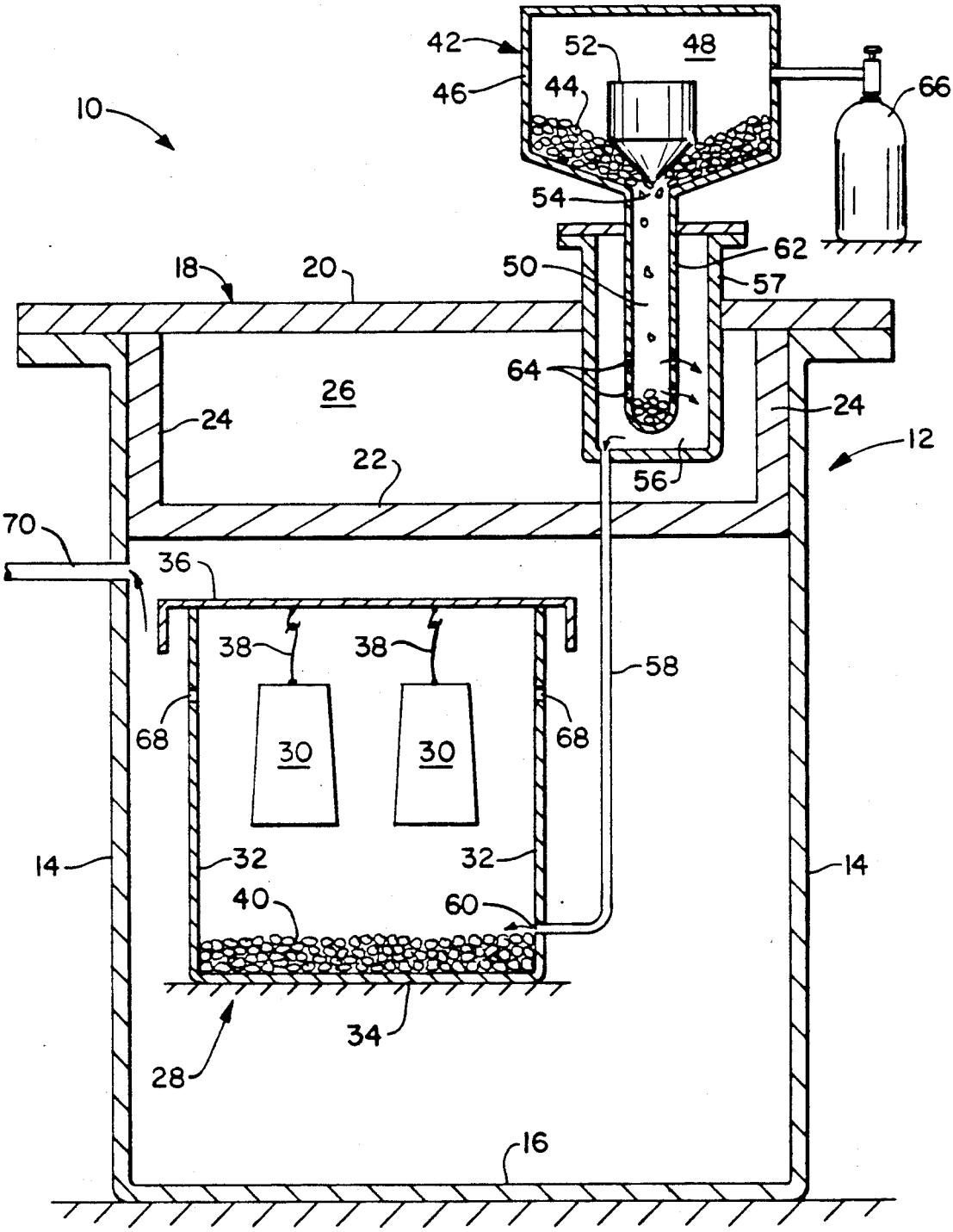
FIG. 1 is a schematic view showing an apparatus in accordance with this invention for applying gas phase diffusion coatings to metal parts.

FIG. 1 shows the three key components of an apparatus 10 used in carrying out the invention. The first component is a furnace represented by the general reference numeral 12. The furnace 12 is of a conventional design and is defined by side walls 14, a bottom wall 16 and a cover 18. The cover 18 is constructed and arranged to seal the contents within the interior portion the furnace 4. The cover 18 comprises top and bottom walls 20 and 22, respectively, joined by side walls 24. The cover walls 20, 22 and 24 define a cavity 26.

Disposed within the furnace chamber 12 is the second key component of this invention, a retort 28 within which the parts 30 to be coated are disposed. The retort 28 is a box-like structure comprising side walls 32, a bottom wall 34 and a top 36. The retort top 36 is detachable from its side walls 32, and the top 36 is constructed and arranged such that the parts 30 are suspended from the top 36. Means for supporting the parts 30 from the top 36 are of a conventional nature and are shown by the reference numeral 38. Disposed along the bottom wall 34 of the retort 28 is a solid source of aluminum metal 40, which is shown in the Figure as being in particulate form. The aluminum source 40 is described in more detail below.

The third key component of the apparatus is a means 42 for delivering gaseous activator to the interior of the retort 28. The activator delivery means 42 comprises a container 46 within which is disposed solid halide activator compound 44 (shown in the Figure in particulate form) which is described in more detail below. The container 46 is divided into upper and lower chambers 48 and 50, respectively, by means 52 for delivering activator 44 from the upper activator chamber 48 (a supply chamber) to the lower activator chamber 50. The delivery means 52 is constructed and arranged for movement in the vertical direction by means not shown; when the delivery means 52 is moved sufficiently upward of the container throat 54, activator falls from the upper chamber 48 into the lower chamber 50. Movement of the delivery means 52 back into the activator throat 54 stops the fall of activator 44 into the lower chamber 50.

As is seen in the Figure, the lower chamber 50 is disposed within a sublimation chamber 56 defined by chamber walls 57. The sublimation chamber 56 is in fluid communication with the interior of the retort 28 by means of tube 58. For reasons which will be made clear below, the outlet end 60 of the tube 58 enters the interior of the retort 28 at a location adjacent to the aluminum source 40.

The sublimation chamber 56 extends into the cavity 26 defined by the cover walls 20, 22 and 24. The cover walls 20, 22 and 24, and sublimation chamber walls 57, are constructed and arranged such that when the parts 30 are at the coating temperature, the temperature in the sublimation chamber 56 is at a temperature sufficient to cause sublimation of activator 44. As indicated above, the coating temperature is the temperature at which the aluminum rich halide gas (which forms when the sublimed activator reacts with the aluminum source) reacts with the part surface to form an aluminide coating. The cover walls and sublimation chamber walls are constructed and arranged such that the upper activator chamber is maintained at a temperature which is too low for sublimation of the activator to take place. The walls 62 which define the lower activator chamber 50 include orifices 64 which are appropriately sized to permit gaseous (sublimed) activator to flow into the sublimation chamber 56, and then through the tube 58 and into the interior of the retort 28, while at the same time preventing solid activator 44 from passing into the sublimation chamber 56.

To facilitate the flow of sublimed activator into the interior of the retort 28, a supply 66 of inert carrier gas is in fluid communication with the lower activator chamber 50. The supply 66 forces sublimed activator to flow into the retort 28, where it contacts the aluminum source 40 during the coating process.

In carrying out the process of this invention using the apparatus shown in FIG. 1, the parts 30 to be coated are raised to their coating temperature, which is between 1,010° C.–1,120° C., by the furnace 12. The best coating temperature is determined experimentally, and is based on the composition and condition of the parts, and the desired composition and thickness of the coating to be applied; it is also based on the composition of the aluminum source, the activator, and the amount of time allotted for the coating process. After the parts have reached the coating temperature, solid activator 44 is delivered from the upper activator chamber 48 to the lower activator chamber 50. As described above, the apparatus of the invention is constructed such that the lower activator chamber 50 is at a temperature optimum for sublimation of the activator. As the activator sublimes in the lower chamber 50, the gaseous activator thus formed is carried into the retort 28 by the flow of inert carrier gas from the supply 66. A key aspect of this invention is that the delivery of solid activator 44 from the upper chamber 48 to the lower chamber 50 does not begin until the parts 30 are at the coating temperature. As a result, the flow of gaseous activator to the retort 28 does not start until such actuator can actually be used to form a coating, i.e., activator does not flow into the retort 28 until the parts 30 are at the coating temperature.

As the gaseous activator is flowed into the retort 28, it contacts the aluminum source 40, which is heated by reason of it being present in the retort 28. Contact of the gaseous activator and the aluminum source 40 results in a reaction taking place which forms an aluminum rich halide gas which fills the interior of the retort chamber 28. As the aluminum rich halide gas comes into contact with the surface of each part 30, the gas reacts with the part surface to form the coating. More specifically, if the part 30 is fabricated from a nickel base alloy, the aluminum halide gas reacts with the part surface to form nickel aluminide. This process proceeds for as long a period of time as aluminum rich halide vapor can react with nickel at the part surface. Gases which accumulate within the retort 28 pass out of the retort 28 and then out of the interior of the furnace through vents 68 and 70, respectively.

Care must be taken in the delivery of solid activator 44 from the upper activator chamber 48 to the lower activator chamber 50. Sublimation of the activator is an exothermic reaction, and delivery of an excessive amount of activator to the lower chamber 50 can significantly raise the temperature within the sublimation chamber 56 and thereby significantly increase the rate of sublimation. Such significant increases in the rate of sublimation can create a dangerous situation within the conversion chamber 56 and should be avoided. A preferred method for delivering solid activator from the upper chamber 48 to the lower chamber 50 is to move the control means 52 in and out of engagement with the container throat 54 at equally spaced intervals of time during the coating process. The objective of such movement is to achieve, as much as is possible in view of the dynamic nature of the sublimation process, a constant amount of solid activator 44 in the lower chamber 50 for sublimation.

Figure 2:
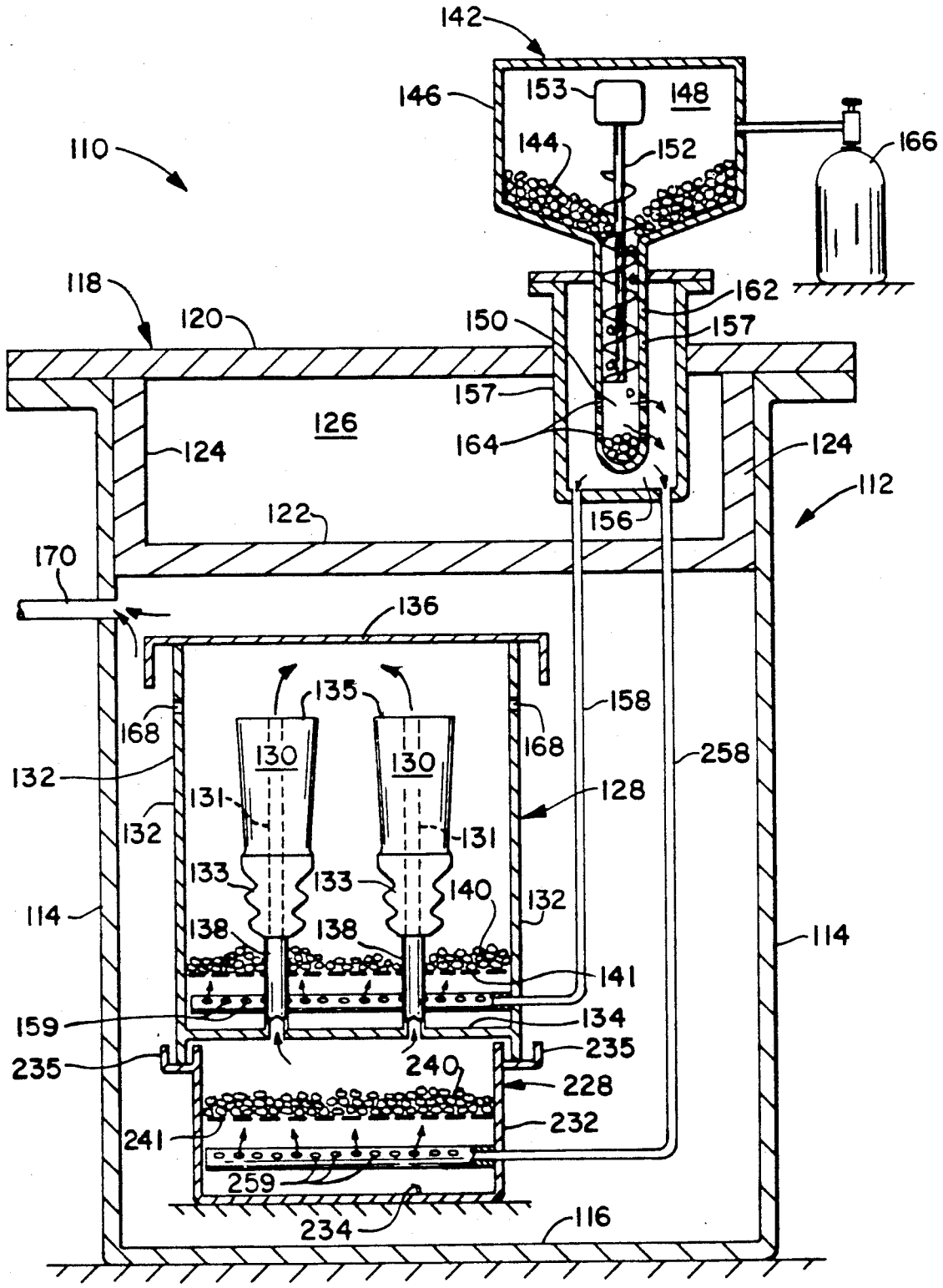
FIG. 2 is a schematic view showing an apparatus in accordance with this invention for applying gas phase diffusion aluminide coatings to the interior and exterior surfaces of hollow gas turbine engine blades.

A preferred embodiment of the apparatus of this invention is shown schematically in FIG. 2. The apparatus is particularly adapted for applying a diffusion aluminide coating to the internal and external surfaces of hollow gas turbine engine blades and vanes.

The apparatus 110 in FIG. 2 comprises a furnace 112 of a conventional design defined by side walls 114, a bottom wall 116, and a cover 118. The cover 118 is constructed and arranged to seal the contents within the interior of the furnace 112. The cover 118 comprises top, bottom and side walls 120, 122 and 124, respectively, which collectively define a cavity 126.

Disposed within the furnace 112 are upper and lower retorts 128 and 228, respectively. The parts 130 to be coated are disposed within the upper retort 128 and are hollow gas turbine engine blades or vanes of the type well known to those skilled in the art. (For simplicity, the parts 130 are referred to below as blades.) The blades 130 have an internal passage 131 which is shown schematically in FIG. 2 as extending from an inlet at the blade base 133 to an outlet at the blade tip 135. (In some blade designs, the passage may extend from the inlet at the blade base to the outlet at the blade leading and/or trailing edges, and does not necessarily extend entirely to the blade tip. Such blade designs are effectively coated in accordance with this invention.)

The upper retort 128 comprises side walls 132, a bottom wall 134 and a top 136. The lower retort 228 comprises side walls 232 and a bottom wall 234. As shown in FIG. 2, the retorts 128 and 228 are constructed and arranged such that the upper retort 128 rests upon flanges 235 which extend from the side walls 232 of the lower retort 228; in this manner, the bottom wall 134 of the upper retort 128 functions as the top wall of the lower retort 228.

Extending through the bottom wall 134 and into the upper retort 128 are means 138 for supporting each blade 130 within the upper retort 128. The support means 138 are constructed to provide, in combination with the passage 131 in each blade 130, a means for gases to flow from the lower retort 228 to the upper retort 128, as shown by the arrows in FIG. 2. In particular, the support means 138 are hollow tubes which allow aluminum rich halide gases, which are generated in the lower retort 228 (in the manner described in more detail below) to flow through each blade passage 131, to coat the wall surfaces which define such passage, and then into the upper retort 128.

Disposed slightly above the bottom wall 234 of the lower retort 228 is a source of aluminum 240 which rests upon a metal mesh 241 or other such gas permeable structure. In similar fashion, disposed near the bottom wall 134 of the upper retort 128 is a source of aluminum 140 which rests upon a metal mesh 141 other such gas permeable structure 128.

The apparatus of FIG. 2 includes means 142 for delivering gaseous activator to the interior of the upper and lower retorts 128 and 228, respectively. The activator delivery means 142 comprises a container 146 within which is disposed a solid activator compound 144, shown in particulate form. The container 146 is divided into upper and lower chambers 148 and 150, respectively, by means 152 for delivering solid activator 144 from the upper chamber 148 to the lower chamber 150. The delivery means 152 in this preferred embodiment is a rotating helicle screw conveyor driven by motor 153.

During the operation of the apparatus shown in FIG. 2, the screw conveyer 152 delivers solid activator 144 at a controlled rate such that, once the blades reach the coating temperature, solid activator 144 is present in the lower chamber 150 for sublimation throughout the coating process. As indicated above, a key aspect of the invention is that delivery of solid activator 144 from the upper chamber 148 to the lower chamber 150 does not begin until the parts 130 have reached the coating temperature. Thereafter, activator 144 is delivered, preferably at a constant rate, during the entire process.

The lower chamber 150 is disposed within a sublimation chamber 15 defined by walls 157. The sublimation chamber 156 is in fluid communication with both the upper retort 128 and the lower retort 228; fluid communication between the sublimation chamber 156 and the retorts 128 and 228 is established by tubes 158 and 158, respectively. As shown in the Figure, the outlet ends of each of the tubes 158 and 258, respectively, are disposed within each tube's respective retort, and are defined by a plurality of apertures 159 and 259. The apertures 159 and 259 are closely spaced from and aligned towards the source of aluminum in their respective retorts to insure that when gaseous activator is flowed into such retorts, it directly contacts such source.

The sublimation chamber 156 extends into the cavity 126 defined by the cover walls 118, 120 and 122. The cover walls 118, 120 and 122 and the sublimation chamber walls 157 are constructed and arranged such that during the coating process, the temperature in the sublimation chamber 156 is sufficient to cause sublimation of solid activator 144 when the blades 130 are at the coating temperature. Preferably, the temperature in the sublimation chamber 156 is at an optimum temperature (as determined experimentally) to cause the activator 144 to sublime.

The walls 162 which define the lower activator chamber 150 include orifices 164 so that gaseous activator, produced when the solid activator 144 sublimes, passes through the orifices 164, into the tubes 158 and 258, and into the retorts 128 and 228.

To facilitate the flow of gaseous activator into the retorts 128 and 228, a supply 166 of inert carrier gas is in fluid communication with the lower activator chamber 150. The supply 166 forces the gaseous activator to flow into each retort 128 and 228 through their respective tubes 158 and 258.

In carrying out the process of this invention using the preferred apparatus shown in FIG. 2, the parts 130 to be coated are raised to their desired coating temperature by the furnace 112. The preferred coating temperature is between 1,010° and 1,120° C. A more preferred coating temperature is between 1,065° C. and 1,095° C. After the parts have reached the coating temperature, solid activator 144 is delivered from the upper activator chamber 148 to the lower activator chamber 150 by the screw conveyer 152. As described above, the apparatus of this invention is constructed and arranged such that when the parts 130 are at the coating temperature, the lower chamber 150 is at the optimum temperature to cause sublimation of activator present in the lower chamber 150. When the activator sublimes in the lower chamber 150, it is carried into the retorts 128 and 228 by the flow of inert carrier gas from the supply 166. Gaseous activator which flows into the lower assembly 228 contacts and reacts with the aluminum source 240 to form an aluminum rich halide gas which passes through the hollow support means 138 and then into the blade cavity 131. As the aluminum rich gas contacts the wall surfaces which define the cavity 131, the gas reacts with such surfaces to form a diffusion aluminide coating. Any of the gas which does not react with the wall surfaces passes out of the blade through the cavity outlet end and into the upper interior of the retort 128.

In a similar and essentially simultaneous fashion, gaseous activator which flows through the tube 158 and into the interior of the upper retort 128 contacts and reacts with the aluminum source 140 to form an aluminum rich halide gas. This aluminum rich gas reacts with the external surfaces of each blade 130 to form a diffusion aluminide coating on such external surfaces.

Gases which collect in the upper retort 128 pass through vents 168 into the interior of the furnace 12. Gases which collect in the furnace interior pass out of the furnace through vents 170.

The apparatus shown in FIGS. 1 and 2 are constructed from high temperature alloys such as Inconel® Alloy 600 (International Nickel Company, New York USA). Other similar alloys will also be useful, as known to those skilled in the art. Sources of aluminum which are useful in carrying out the process of this invention are preferably in particulate form, nominally about 3 to 9 millimeters in diameter, and are selected from the group consisting of pure aluminum, compounds of aluminum (e.g., $Co_2Al_5$, $Ni_3Al$, $Fe_2Al_5$) and alloys of aluminum (e.g., Al-10% Si), as described in U.S. Pat. Nos. 4,132,816, 3,958,047, 4,332,843, and 4,835,011; all are incorporated herein by reference. Cobalt aluminum ($Co_2Al_5$) is the preferred source of aluminum. Solid activator compounds which are useful include the halides of alkali and alkaline earth metals, as described in the aforementioned patents. Ammonium bifluoride is the most preferred activator. Most preferably, the activator is in the form of particulate crystals. Materials such as aluminum oxide can be mixed with the aluminum source to act as a buffer or diluent as described in U.S. Pat. No. 3,667,985, incorporated herein by reference, and in U.S. Pat. No. 4,835,011.

Use of the invention, and in particular, the method by which gaseous activator is brought into contact with the source of aluminum, results in an optimum use of activator and a controlled and efficient application of a diffused coating into the part surface. These benefits and advantages over the prior art are achieved by delaying the moment at which gaseous activator and the aluminum source first react with each other until such time that the parts to be coated are at the coating temperature.

As an example of this invention, an apparatus of the type shown in FIG. 2 was constructed. The retort within which the parts were disposed was about 15×13×13 centimeters in size. About 175 grams of Co was evenly divided between the upper and lower retorts. During the course of several coating cycles which lasted between about 2 and 4 hours, additions of ammonium bifluoride of between about 4.7 and 8.5 grams per hour were successfully shown to deposit a diffusion aluminide coating which averaged about 75 microns in thickness on the internal and external surfaces of gas turbine engine blades fabricated from nickel base superalloys. The coating temperature during such cycles was between about 1,065° C. and 1,095° C. The activator Was added to the lower activator chamber at regular intervals which were about 10 to 15 minutes apart. Use of the invention resulted in an efficient use of activator and a controlled and desired amount of aluminum diffusion into the part surface.

The specific amounts of $Co_2Al_5$ and ammonium bifluoride which were used in this example, and the rate at which the activator was added (and therefore consumed) is significantly influenced by the size of the retort within which the parts are disposed. Other factors which affect the amount of raw materials which will be consumed include the coating temperature; the compositions of the aluminum source, activator, and parts; the time of the process; and the desired thickness of the coating. Those skilled in the art, guided by the teachings of this specification, will be able to determine the optimum combination of conditions for specific coating requirements.

Even though the invention has been described in terms of the deposition of a simple aluminide coating, diffusion coatings having other compositions may also be deposited. For example, aluminide coatings which contain additions of oxygen active elements such as yttrium, as described in U.S. Pat. No. 4,835,011 to Olson et al., can be formed using this invention. The metal source used to form such coatings contains aluminum, yttrium, and one or more of the elements selected from the group of silicon, chromium, cobalt, titanium and nickel; the most preferred source is an aluminum-yttrium-silicon alloy. Diffusion coatings containing additional elements may also be formed utilizing the teachings of this invention. For example, U.S. Pat. Nos. 4,933,239 and 4,910,092 to Olson et al., and 4,897,315 to Gupta, which are all incorporated herein by reference, describe processes for aluminizing overlay coatings containing nickel, cobalt, chromium, aluminum, yttrium and, optionally, silicon, hafnium and noble metals. The aluminizing step to form such coatings may be carried out in accordance with the present invention. U.S. Pat. No. 4,501,776 to Shankar, which is incorporated herein by reference, describes a process for aluminizing a coating of a platinum metal group. The aluminizing process to form such coating may be carried out in accordance with this invention. U.S. Pat. No. 4,148,936 to Grisik et al., which is incorporated herein by reference, describes a process for applying a diffusion coating based on chromium to components used in gas turbine engines. Such coatings may be formed in accordance with this invention by utilizing chromium powder or a similar source of chromium. Other types of diffused metal coatings on metal articles which may be formed in accordance with this invention will be apparent to those skilled in the art. The coatings all are based on an element which is capable of forming a relatively stable metal oxide layer on their surface during use at high temperatures; the best such layers are those containing aluminum and/or chromium as a major constituent.

Although this invention has been shown and described with respect to detailed embodiments thereof, it will be understood by those skilled in the art that various changes in form and detail may be made without departing from the spirit and scope of that which is claimed.

What is claimed is:

1. A gas phase deposition process for forming a diffused metal coating on a metal article, comprising:

(a) heating the article and a source of the metal for forming the coating in a first enclosure to a first temperature;

(b) heating an activator in a second enclosure to a second temperature sufficient to vaporize the activator, said second temperature being less than said first temperature;

(c) flowing the activator vapor from the second enclosure into the first enclosure, and reacting the vapor with the metal source to produce a metal rich vapor; and (d) reacting the vapor with the article at the first temperature to form the coating, wherein said flowing step begins after the article is at the first temperature.

2. The process of claim 1, further comprising the step of flowing an inert gas into the second enclosure to force the activator vapor into the first enclosure.

3. The process of claim 2, wherein the activator is added to the second enclosure at equally spaced apart time intervals.

4. The process of claim 2, wherein the activator is in particulate form.

5. A gas phase deposition process for forming a diffused aluminide coating on a nickel or cobalt based article, comprising:

(a) heating the article and a source of aluminum in a first enclosure to a first temperature between about 1,010° C. and 1,120° C.;

(b) heating a halide activator in a second enclosure to a second temperature less than the first temperature, said second temperature being sufficient to vaporize the activator;

(c) flowing an inert gas into the second enclosure to force the activator vapor from the second enclosure into the first enclosure, and reacting the activator vapor with the aluminum source while the source is between about 1,010° C. and 1,120° C., to produce an aluminum rich halide gas, wherein said flowing step begins after the article is at the first temperature; and (d) reacting the aluminum rich halide gas with the article to form a diffused aluminide coating.

6. The process of claim 5, where the source of aluminum is selected from the group consisting of pure aluminum and alloys of aluminum.

7. The process of claim 6, wherein the halide activator is selected from the group consisting of ammonium and alkali earth metal halides.

8. The process of claim 7, wherein the source of aluminum is cobalt aluminum and the activator is ammonium bifluoride.

9. A process for applying a gas phase diffusion aluminide coating to the surface of a metal part comprising the steps of heating the part, a halide activator and a source of aluminum capable of reacting with the activator to form an aluminum rich halide gas, and then reacting said gas with the part at a coating temperature sufficient for the coating to form on the part surface, wherein the improvement comprises delaying the moment at which the activator first reacts with the aluminum source until such time that the part is at the coating temperature.

10. The process of claim 9, wherein the article is selected from the group consisting of nickel and cobalt base superalloys, the aluminum source is selected from the group consisting of pure aluminum, compounds of aluminum and alloys of aluminum, and the activator compound is selected from the consisting of alkali and alkaline earth halides.

11. The process of claim 9 further comprising the step of heating the article to be coated and the source of aluminum in a first chamber to a first temperature equal to the coating temperature, and heating the activator compound in a second chamber to a second temperature sufficient to vaporize the activator, wherein the second temperature is less than the first temperature; and flowing the activator vapor from the second chamber into the first chamber.

12. The process of claim 11, wherein said step of flowing starts after the article and source of aluminum are at the first temperature and the activator compound is at the second temperature.

13. The process of claim 11 further comprising the step of delivering the activator compound from a supply chamber to the second chamber, wherein the temperature of the supply chamber is below the temperature at which vaporization of the activator compound takes place.

14. The process of claim 13 comprising delivering activator from the supply chamber to the second chamber at a constant rate during said process.

15. The process of claim 14, wherein said flowing step further comprises the step of flowing an inert carrier gas into the second chamber and then from the second chamber into the first chamber, wherein the flow of carrier gas forces activator vapor from the second chamber to the first chamber.

16. A process for applying a gas phase diffusion aluminide coating to the surface of a gas turbine engine component fabricated from a nickel base or cobalt base superalloy, comprising the steps of heating the component and a source of aluminum in a first chamber to a temperature in the range of about 1,065° C. to 1,095° C.; heating a halide activator compound in a second chamber to vaporize the activator; and flowing the activator vapor from the second chamber into the first chamber to cause the vapor to react with source of aluminum to form an aluminum rich halide vapor, and then reacting said vapor with the part surface to form an aluminide coating.

* * * * *